United States Patent [19]

Stein et al.

[11] Patent Number: 4,732,394

[45] Date of Patent: Mar. 22, 1988

[54] TARGET RAISING DEVICE

[76] Inventors: C. Francis Stein, R.R. 3, Box 313; Leon E. Winslow, R.R. 3, Box 199, both of Waldoboro, Me. 04572

[21] Appl. No.: 3,724

[22] Filed: Jan. 16, 1987

[51] Int. Cl.[4] ..... F41J 7/04

[52] U.S. Cl. ..... 273/391

[58] Field of Search ..... 273/391, 392

[56] References Cited

U.S. PATENT DOCUMENTS 2,736,558 2/1956 Ruderman ..... 273/391

3,064,976 11/1962 Kuhn ..... 273/391 X

*Primary Examiner*—Anton O. Oechsle

[57] ABSTRACT

An automated device for raising shooting range targets of the type which are arranged to fall over backwards from the impact of a bullet comprises a base having a vertical flange adapted to face the firing line when the device is installed on the range and a horizontal flange extending rearwardly therefrom. The target is hinged to the top of the vertical flange and is adapted to swing backwardly to a generally horizontal rest position concealed from the view of the shooter and upwardly and forwardly to an upright position facing the firing line. A main shaft driven by an electric motor is revolvably mounted behind the upright flange portion. A target raising arm, one for each target, pivots on the axis of the main shaft and swings from a rest position beneath the target when the latter is in its rest position upwardly about its pivot to engage and raise its target to upright position. A clutch transmits rotary motion from the shaft to the arm, the clutch releasing the arm when the target has reached its upright position releasing the arm to swing backwards to its rest position. Electrical circuitry permits the range officer to control operation of the device from the firing line.

13 Claims, 12 Drawing Figures

FIG. 5
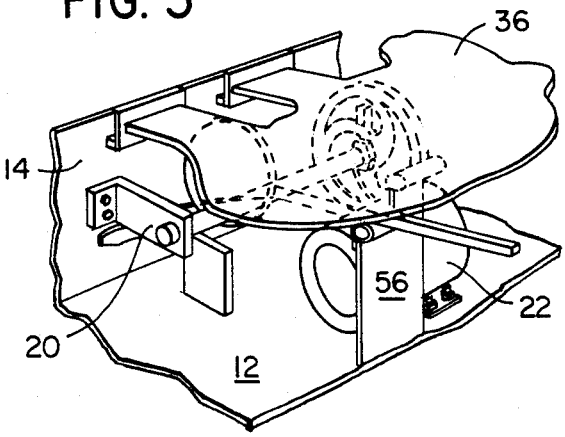
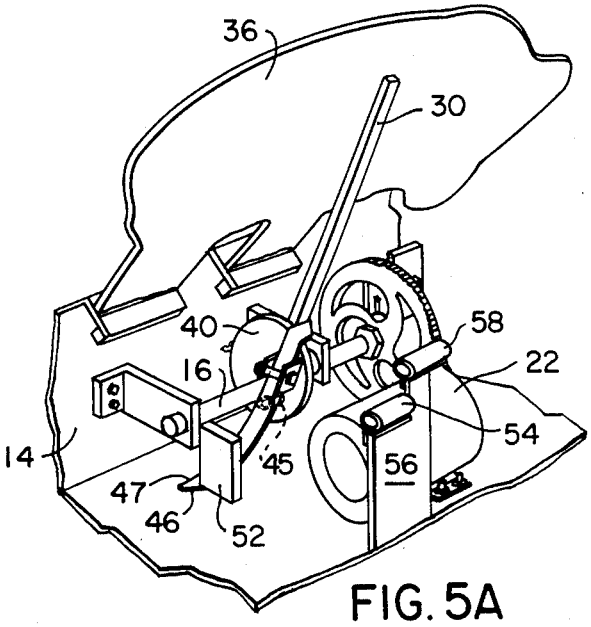
FIG. 5A
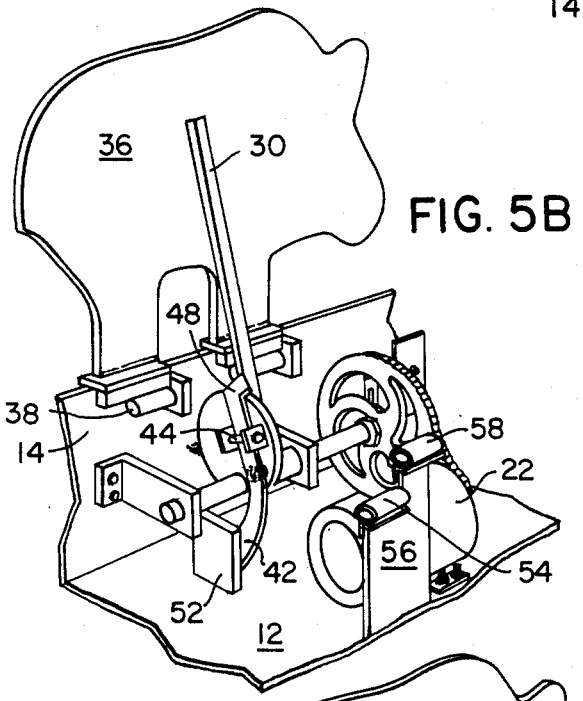
FIG. 5B
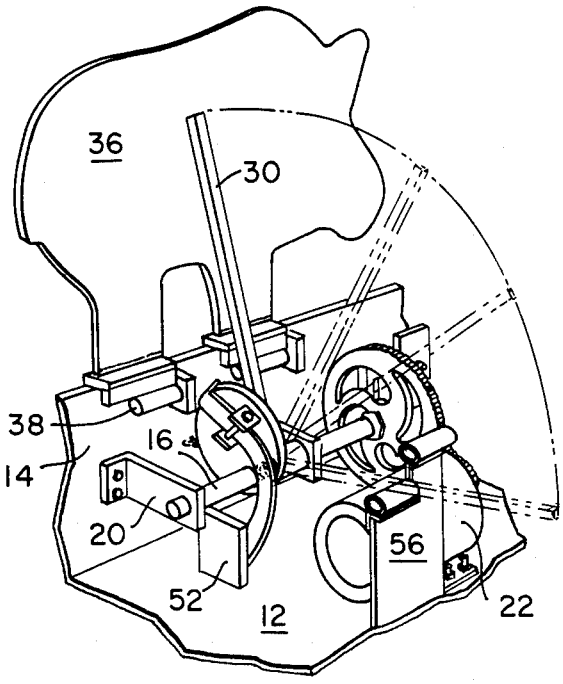
FIG. 5C
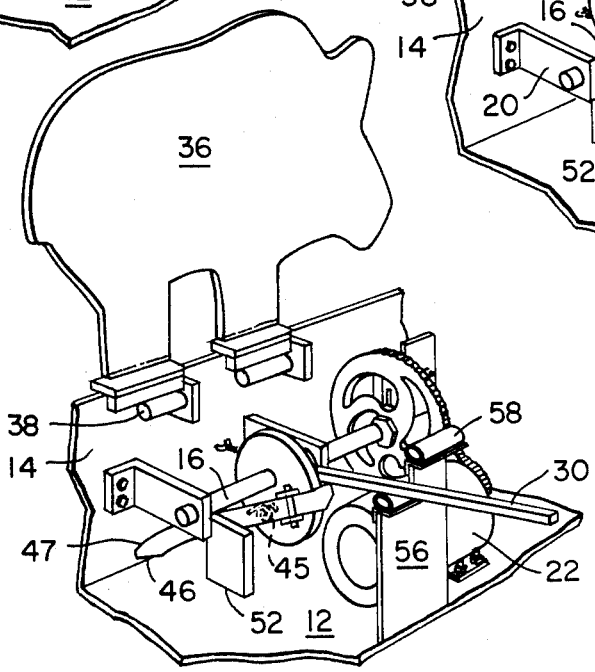
FIG. 5D

TARGET RAISING DEVICE

This invention relates to automated target raising equipment for shooting ranges.

BACKGROUND OF THE INVENTION

Target raisers are commonly used for raising and lowering targets simultaneously or turning them to face the shooter for a predetermined time period and then turning them 90° so their edges are toward the shooter. Some are portable so as to be readily transportable from range to range. So far as I am aware, it has never been proposed to provide target raising mechanism for targets of the type which are designed to be knocked over when hit by a bullet so as to make it unnecessary for the shooter to go forward and manually raise the target each time it is hit.

It is an object of the present invention to provide automated mechanism for engaging and selectively raising those shooting range targets which have been knocked over by bullet impact so as to eliminate need for the shooter to go forward and manually raise them each time.

SUMMARY OF THE INVENTION

In accordance with the invention there is provided an automated device for raising shooting range targets of the type which are arranged to fall over backwards from the impact of a bullet which comprises a main frame or base having a raised portion adapted to face the firing line when the device is installed on the range for use and another portion extending rearwardly therefrom. At least one target is hinged to the raised portion and is adapted to swing backwardly therefrom to a generally horizontal rest position concealed from the view of the shooter and upwardly and forwardly from the rest position to an upright position facing the firing line. A main shaft is revolvably mounted behind the raised portion. A target raising arm is pivotally mounted and has a first rest position beneath the target when the latter is in its rest position and is adapted when swung upwardly about its pivot to engage and raise the target to its upright position. Means are provided for rotating the shaft. Clutch means transmit rotary motion from the shaft to the arm to swing it from its rest position to raise the target. Means are also provided for releasing the clutch from the arm when the target has reached its upright position to permit the arm to swing backwards to its rest position.

Other aspects of the invention include: the provision of supports mounted on the rearwardly extending portion of the main frame or base for supporting target and arm in their rest positions; a sleeve loosely surrounding a portion of the main shaft to which one end of the arm is affixed so that the arm will pivot on the axis of said shaft when raised or lowered; clutch mechanism revolving with the shaft for engaging the arm and raising the latter; and cam means for releasing the clutch when the target has reached its upright position so that the arm becomes free to fall back to its first rest position.

In a preferred embodiment, the clutch mechanism comprises a member eccentrically fastened to and revolvable with the main shaft and an arm lifter pivoted thereon for rocking movement at a point intermediate its ends, one end of the lifter adapted when rocked to lifting position to extend beneath and into lifting engagement with the arm for raising the latter, and the other end being arranged to be cammed against a spring when the target has reached its upright position so as to rock the first named end out of engagement with the arm thereby releasing the latter to fall back to its first rest position, the spring thereafter rocking the lifter back to its normal position adapted again to engage the arm for lifting the latter.

Another aspect of the invention includes hinging the target to the raised portion of the base in such a way that when upright its center of gravity is forward of the hinge axis, whereby the target is self-supporting but not locked in its upright position.

In one preferred embodiment the aforementioned arm supporting sleeve is connected by a spring to the raised portion, the spring being tensioned by rotation of the sleeve whereby the arm is urged by the tensioned spring from its raised position toward its rest position upon release of the clutch; an electric motor is arranged for rotating the shaft through a 360° cycle, clutch means transmit rotary motion from the shaft to the arm to swing the latter from its rest position to raise the target during the first part of the 360° cycle, and means are provided responsive to the angular position of the shaft to stop the motor at the end of each cycle.

Still further according to the invention there are provided controls for the electric motor comprising a control box adapted to be located at a convenient location on the shooting range and connected to a power source, switching means therein for directing electric current to the motor for initiating the cycle and means sensing and actuated by the angular position of the shaft for interrupting the current when the shaft has completed a cycle thereby stopping the motor.

A still further preferred embodiment includes a driving member on the shaft of the motor, a driven member on the main shaft in driven relation to the driving member, a normally closed microswitch in the circuit feeding current to the motor, and a cam on the driven member arranged to engage and open the microswitch to stop the motor at the conclusion of each revolution of the main shaft. In this embodiment, preferably, the switching means includes means for momentarily bypassing the microswitch so as to start and run the motor to rotate the driven member through a sufficient angular distance to release the cam from the microswitch thereby closing the latter for the continued feed of current to the motor.

Still further objects, features and advantages of the invention will become apparent from the following detailed description of a presently preferred embodiment thereof taken in conjunction with the accompanying drawings.

BRIEF DESCRIPTION OF THE DRAWINGS

FIG. 5 is a perspective of the mechanism shown in the previous figures with the target in knocked down position;

FIG. 5A shows the target partially raised;

FIG. 5B shows the target fully raised;

FIG. 5C shows the path through which the target raising arm swings to its lowermost position after being disengaged from the back of the target;

FIG. 5D shows such arm returned to its initial rest position from which it is swung to raise the target;

DETAILED DESCRIPTION OF PREFERRED EMBODIMENT

Figure 6:
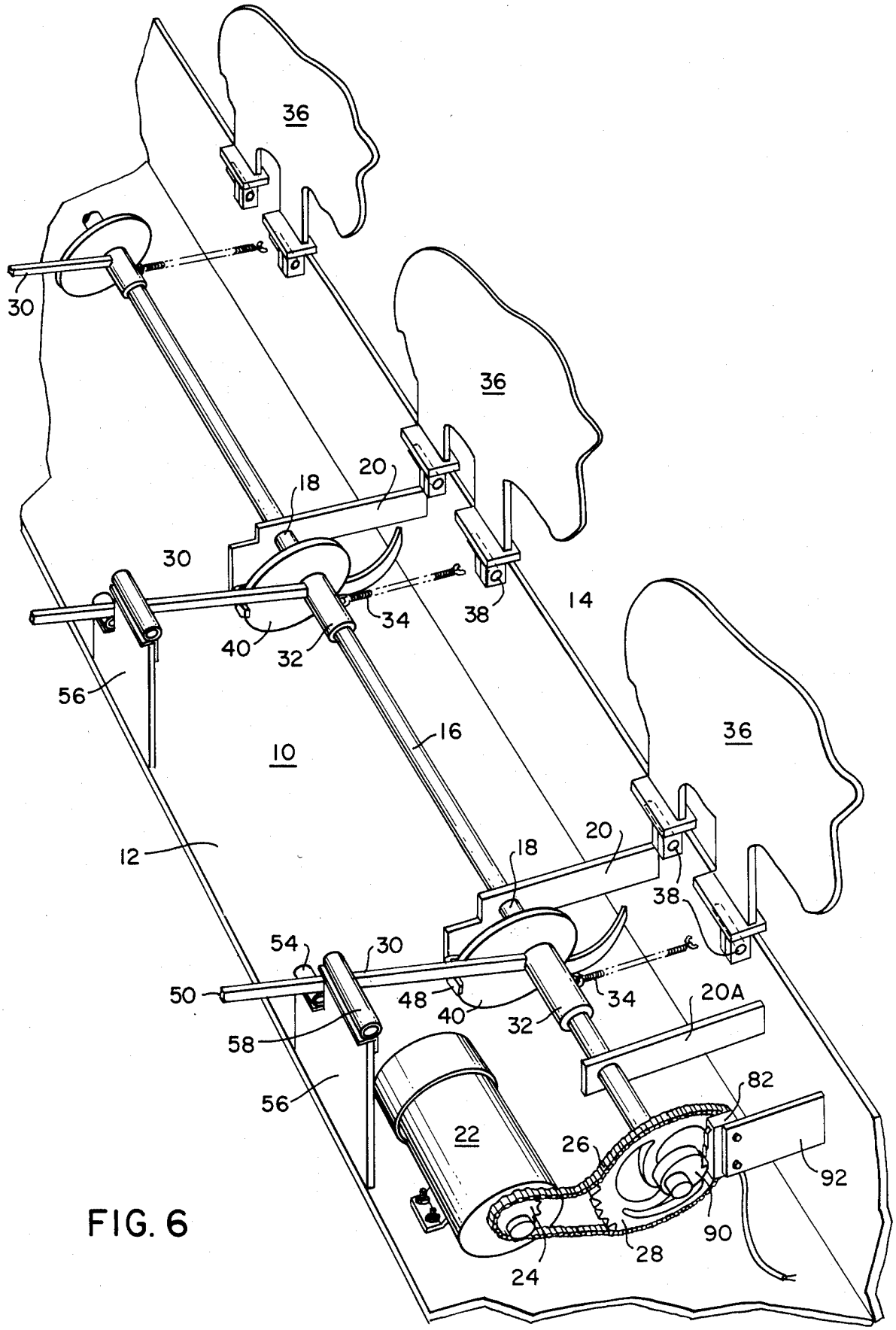
FIG. 6 is a view in perspective showing how the novel target raising mechanism is arranged for raising a plurality of targets.

The general arrangement of the novel target raising device is best seen in FIG. 6. In this view a single electric motor is shown disposed and arranged to drive a single main shaft for raising more than one target, all the components for the several targets being mounted on a base 10 which is shown as an L-beam having a horizontal flange 12 and a vertical flange 14. It will nevertheless be understood that the target raising device of the invention need not be manufactured as a continuous structure. Indeed, if weight is a consideration, each target raising station may have its own individual base, the bases being securely bolted to suitable separate concrete foundations appropriately spaced from each other. In the following description it should be understood that the device may comprise either a continuous or a discontinuous structure.

As here shown, shaft 16 is journaled in bearings 18 in brackets 20 and 20A which are in turn mounted on and extend rearwardly from the vertical flange 14. The shaft 16 is revolved by motor 22 through sprocket 24, chain 26 and sprocket 28.

Each target raising arm 30 comprises a steel bar one end of which is fixed in a sleeve 32 which is loose on shaft 16 so as not to be rotated thereby. A spring 34 connects the sleeve 32 to the front flange 14 of the base 10 for a purpose which will be described below. Arm 30 is shown in FIG. 6 in its rest position on padded ledge 54. A screen door type closer or other suitable shock absorber may be employed to receive and support the arm after it falls to rest position.

The targets 36 are hinged at 38 to the top edge of flange 14. They are shown in their upright position in FIG. 6 and lowered position in FIG. 5. They are swung to the upright position by arm 30 as will be explained. In their rest position each is held on a padded ledge 58 adjacent ledge 54. The two ledges 54, 58 are provided by the top edge of an upright 56. The ledge 58 is elevated above the ledge 54 so that when both target and arm are in rest positions the arm is located beneath the target in position to engage and raise it when actuated.

Figure 2:
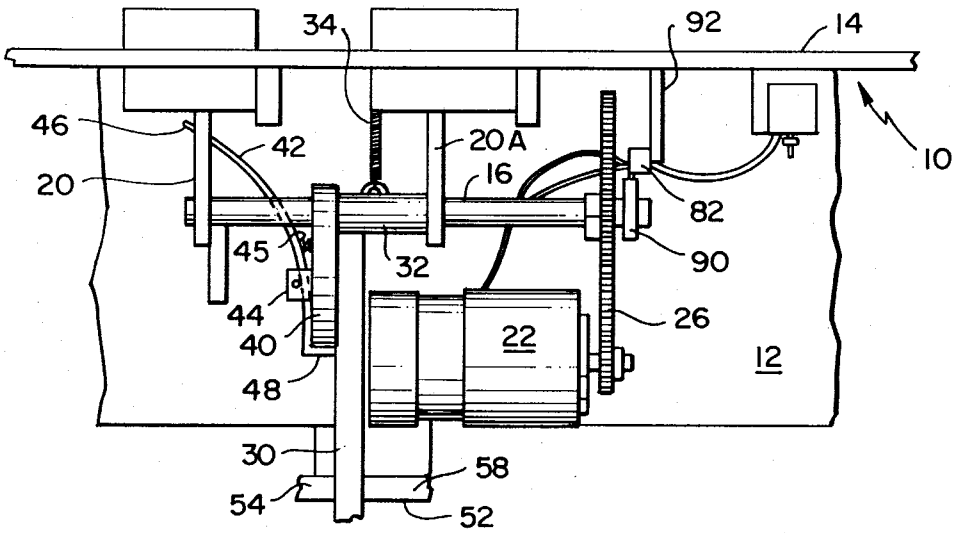
FIG. 2 is a plan view of the same.
Figure 4:
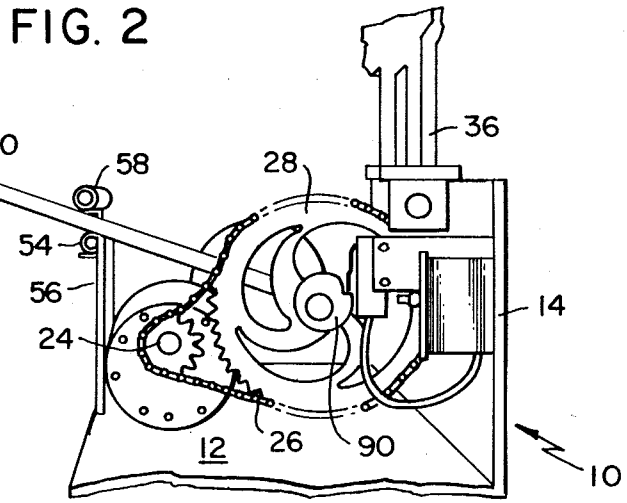
FIG. 4 is a side elevational view of the same as seen from the opposite side.
Figure 2A:
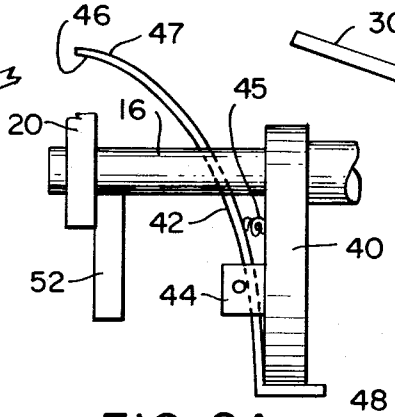
FIG. 2A is a fragmentary detail of the rockable spring pressed arm lifter which engages and raises the target raising arm and then releases the same when it reaches its upright position.

In order to swing target raising arm 30 from its rest position to raise a target, a clutch mechanism revolving with shaft 16 is provided, as best seen in FIGS. 2A, 5A–5B. A disc 40 is eccentrically affixed to the shaft 16. An arm lifter in the form of a lever 42 is pivoted near its center for rocking motion by fastening member 44 and is adapted to rotate with the disc 40. The upper end 48 of lever 42 is bent at substantially a right angle across the perimeter of disc 40 and extends beyond the same a sufficient distance to engage the arm 30. The other end 47 of the arm lifter is bent in the opposite direction and is provided with a bevelled surface at 46 adapted to engage fixed cam 52. The lever 42 is urged to its initial position for engaging the arm 30 by spring 45. It is apparent that the lifter 42 may rock about the pivot 44 and this occurs as follows.

The target raising cycle is initiated when shaft 16 commences to turn. Now, referring to FIGS. 2A, 5 and 5A - 5B, portion 48 of lifter 42, urged to actuating position by spring 45, is hooked under arm 30 and, as the shaft turns raises the same to the upright position shown in FIG. 5B. At this point the lower end 46 of lifter 42 comes into engagement with fixed cam 52 which cams end 46 to the right as seen in FIGS. 5A and 5B so that the lifter rocks counterclockwise against the compression of spring 45, as seen in these figures, so that its upper end 48 is disengaged from the arm 30. The arm is now free to fall back to its rest position while shaft 16 and disc 40 complete their 365° cycle. However, since at this point in the cycle arm 30 is leaning forward of its pivot on the axis of shaft 16, means must be provided for swinging it back beyond the vertical so that gravity can take over and drop it onto its rest 54.

In order to return the arm to rest position, spring 34 comes into play. It will be seen that each spring 34 will be tensioned by being partly wound about sleeve 32 as the latter is rotated by swinging of the arm 30. When the clutch mechanism disengages the arm the stored energy in the spring will revolve the sleeve 32 in the opposite direction, thus raising the arm from its forward leaning position of FIG. 5B and permitting it, as soon as its center of gravity moves to the rear of its pivotal axis, to drop by gravity onto its ledge 54.

It will be noted that each target 36 is hinged to flange 14 in such a way that its center of gravity is forward of the hinge axis when the target is in fully raised position. Thus, the targets will remain upright of their own accord until impacted by a projectile, whereupon the impacted targets will be destabilized and fall rearwardly by gravity landing on shelves 58 which are provided with suitable shock absorbers.

A system of electrical controls is provided for operating the target raising mechanism. It is first necessary to actuate motor 22 to initiate the cycle. The device must then revolve shaft 16 and disc 40 through a complete 360° revolution and then stop automatically in condition to initiate the next cycle.

Figure 7:
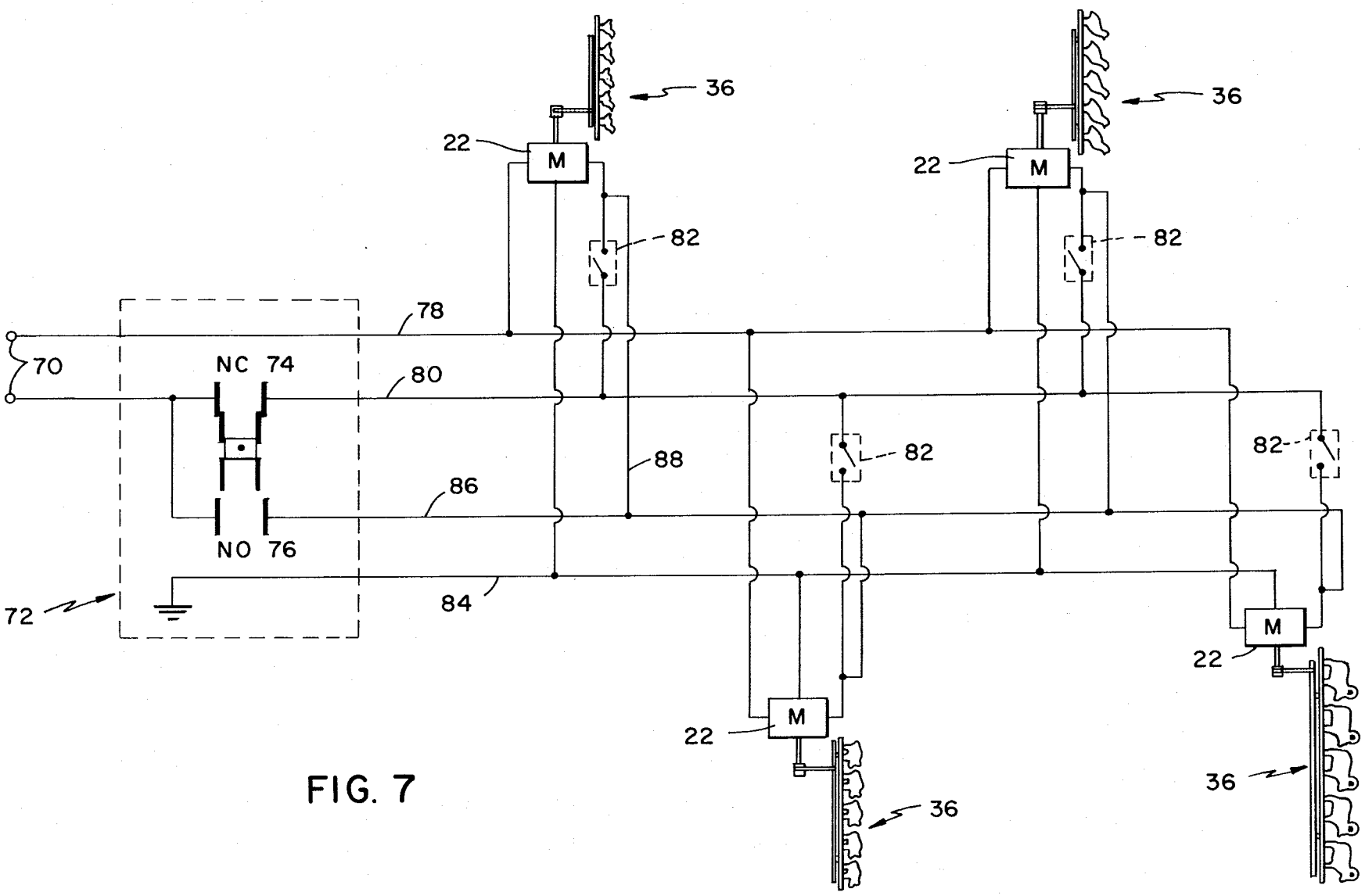
FIG. 7 is a wiring diagram illustrating the electrical system for controlling and actuating the target raising device of the invention.

Referring to FIG. 7, power is derived from power mains or a portable generator (not shown) which may be connected to the system at 70. Target control 72 is operated by the range control officer and is located usually at the range firing line. The control 72 comprises a normally closed switch 74 and a normally open switch 76. One side of the line by-passes the control and is connected directly to one side of each motor 22 by means of conductor 78. The other side of the line is connected through normally closed switch 74 and conductor 80 to one side of microswitch 82 which, when closed, connects the same to the other side of motor 22. Such other side of the motor is also connected to the normally open switch 76 through conductors 86 and 88, by-passing microswitch 82. When normally open switch 76 is closed the motor will be energized even though the micro-switch 82 is open. The motors, of course, should be suitably grounded through ground wire 84. Switch 74 may be opened to isolate the microswitches from the mains 70.

The operation of the electrical controls is as follows. To raise downed targets the range officer presses a button to close momentarily normally open switch 76. Current then passes through the motors by means of conductors 78, 88 and 86, initiating the target raising operation. At the time normally open switch 76 is closed the micro-switch 82 is open wherefor no current can pass through conductor 80 to or from the motor. The device is thus at rest when switch 74 is closed and switches 76 and 82 are both open.

Figure 1:
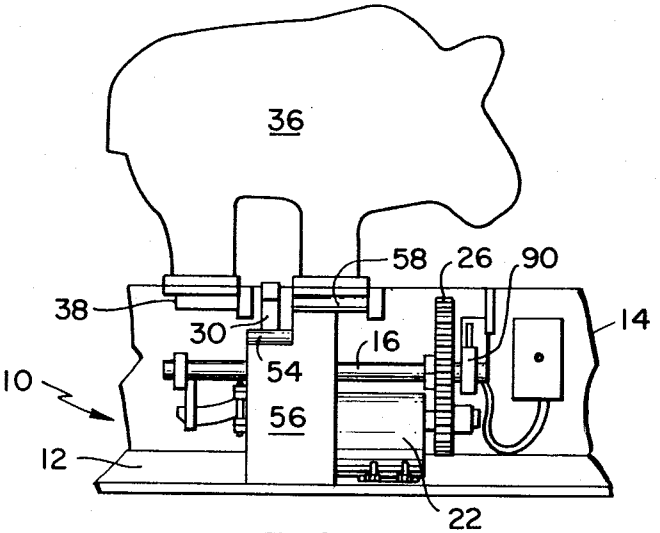
FIG. 1 is a rear elevation of that portion of target raising device according to the invention containing the motor, arm and gear arrangement for raising targets which have been knocked down, the target being shown in raised position.
Figure 3:
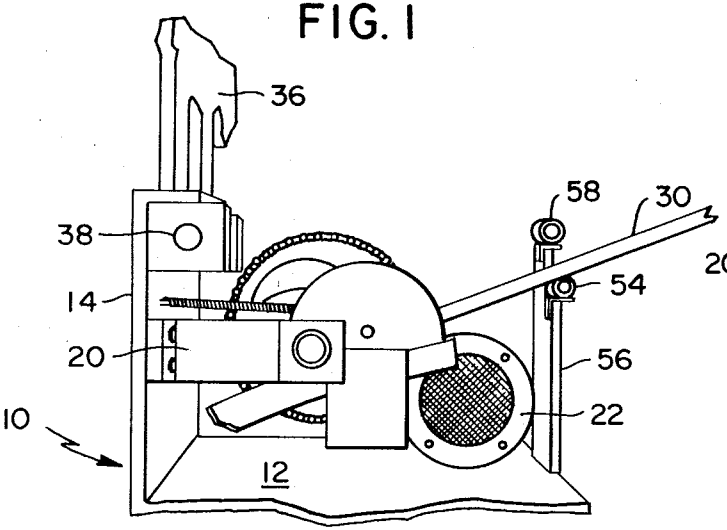
FIG. 3 is a side elevational view of the device as seen from the left side of FIG. 1.

Micro-switch 82 is opened by cam 90 revolving with shaft 16. Switch 82 is mounted on bracket 92 (FIGS. 1, 2 and 6) affixed to the vertical flange 14 in proper position relative to cam 90 for actuation by the latter. When the target raising arm 30 and the arm lifter 42 are in their rest positions shown in FIGS. 1–4 and 6, micro-switch 82 is depressed by cam 90, thus maintaining circuit 80 in open condition so no current can pass through the motor. When switch 76 is momentarily closed, current flows through the motor, revolving shaft 16 and cam 90 thus instantly releasing pressure on the micro-switch permitting it to close. Thereupon, for the remainder of the cycle, current flows through both the micro-switch 82 and conductor 80 thereby actuating the motor 22 to drive shaft 16, raise arm 30 and correspondingly any downed targets. When cam 90 has revolved through 360° it again actuates micro-switch 82 which opens, stopping the motor. It remains open and the motor stopped until the cycle is again initiated by the momentary closing of normally open switch 76.

As is apparent from FIG. 6, the target raiser of the invention is adapted for raising a plurality of targets simultaneously. The base 10 can be made as long, within reason, as desired and targets may be spaced along it. Alternatively, individual raisers may be mounted on individual mutually spaced bases. In the latter case, each base should have a concrete foundation, preferably extending below frost line. The shaft 16 can be extended from base to base so as to actuate as many target lifters as desired, nevertheless driven by a single motor 22. Since the targets are usually quite heavy the power required to lift many targets may become a problem, but the calculation of power requirement is well within the skill of the art.

While there has been herein disclosed and described a presently preferred embodiment of the invention, it will nevertheless be understood that the same is by way of illustration and not be way of limitation and it is intended that the scope of the invention be limited only by the proper interpretation of the appended claims

We claim:

1. An automated device for raising shooting range targets of the type which are arranged to fall over backwards from the impact of a bullet which comprises a base having a raised portion adapted to face the firing line when the device is installed on the range and another portion extending rearwardly therefrom, at least one target hinged to said raised portion and adapted to swing backwardly therefrom to a generally horizontal rest position concealed from the view of the shooter and upwardly and forwardly from said rest position to an upright position facing the firing line, a main shaft revolvably mounted behind said raised portion, a target raising arm pivotally mounted and having a first rest position beneath said target when the latter is in its rest position and adapted when swung upwardly about its pivot to engage and raise said target to its upright position, means for rotating said shaft, clutch mechanism for transmitting rotary motion from said shaft to said arm to swing said arm from its rest position to raise said target, and means for releasing said clutch mechanism from said arm when said target has reached its upright position to permit said arm to swing backwards to its rest position.

2. The device of claim 1 including supports mounted on said rearwardly extending portion of said base for supporting said target and said arm in their rest positions.

3. The device of claim 1 wherein one end of said arm is affixed to a sleeve loosely surrounding a portion of said main shaft so that said arm will pivot on the axis of said shaft when raised or lowered.

4. The device of claim 3 wherein said clutch mechanism revolves with said shaft and is adapted to engage said arm and raise the latter.

5. The device of claim 4 including means for releasing said clutch mechanism from said arm when said target has reached its upright position so that said arm is free to fall back to its first rest position.

6. The device of claim 5 wherein said clutch mechanism comprises a member eccentrically fastened to and revolvable with said main shaft and an arm lifter pivoted thereon for rocking movement about a pivot intermediate its ends, one end of said lifter adapted when rocked to lifting position to extend beneath and engage said arm to raise the latter, and the other end of said lifter being arranged to be cammed when said target has reached its upright position so as to rock said first named end out of engagement with said arm thereby releasing the latter to fall back to its first rest position.

7. The device of claim 6 including a spring for urging said lifter to arm raising position.

8. The device of claim 1 wherein said target is hinged to said raised portion in such a way that when upright its center of gravity is forward of the hinge axis whereby said target is self-supporting in said upright position.

9. The device of claim 5 wherein said sleeve is connected to said raised portion by a spring which is tensioned by rotation of the former whereby said arm is urged by said spring from its raised position toward its rest position when said clutch is released.

10. An automated device for raising shooting range targets of the type which are arranged to fall over backwards from the impact of a bullet which comprises a base having a raised portion adapted to face the firing line when the device is installed on the range for use and another portion extending rearwardly therefrom, at least one target hinged to said raised portion and adapted to swing backwardly therefrom to a generally horizontal rest position concealed from the view of the shooter and upwardly and forwardly from said rest position to an upright position facing the firing line, a main shaft revolvably mounted behind said raised portion, a target raising arm pivotally mounted and having a first rest position beneath said target when the latter is in its rest position and adapted when swung upwardly about its pivot to engage and raise said target to its upright position, an electric motor for rotating said shaft through a 360° cycle, clutch mechanism for transmitting rotary motion from said shaft to said arm to swing said arm from its rest position to raise said target during the first part of said cycle, means for releasing said clutch mechanism from said arm when said target has reached its upright position to permit said arm to swing backwards to its rest position, and means responsive to the angular position of said shaft to stop said motor at the end of each cycle.

11. The device of claim 10 including controls for said electric motor, said controls comprising a control box adapted to be located at a convenient location on the shooting range and connected to a power source, switching means in said control box for directing electric current to said motor and initiating said cycle and means sensing and actuated by the angular position of said shaft for continuing to direct current to the motor during the cycle and interrupting said current when said shaft has completed a cycle thereby to stop said motor.

12. The device of claim 11 including a driving member on the shaft of said motor, a driven member on said main shaft in driven relation to said driving member, a normally closed micro-switch in the circuit feeding current to said motor, and a cam on said driven member arranged to engage and open said micro-switch to stop said motor at the conclusion of each revolution of said main shaft.

13. The device of claim 12 wherein said switching means includes means for momentarily by-passing said micro-switch so as to start and run said motor to rotate said driven member through a sufficient angular distance to release said cam from said micro-switch permitting the latter to close for the continued feed of current to said motor.

* * * * *